United States Patent [19]

Schneider

[11] Patent Number: 4,909,487

[45] Date of Patent: Mar. 20, 1990

[54] PROCESS AND NOTCH GUN FOR CLOSING THE TAPHOLES OF FURNACES

[75] Inventor: Werner Schneider, Siegen, Fed. Rep. of Germany

[73] Assignee: Dango & Dienenthal Maschinenbau GmbH, Siegen, Fed. Rep. of Germany

[21] Appl. No.: 295,298

[22] Filed: Jan. 10, 1989

[30] Foreign Application Priority Data

Feb. 3, 1988 [DE] Fed. Rep. of Germany ..... 3803132

[51] Int. Cl.[4] ..... C21B 7/12

[52] U.S. Cl. ..... 266/273; 266/271

[58] Field of Search ..... 266/271, 272, 273, 45

[56] References Cited

U.S. PATENT DOCUMENTS 4,637,590 1/1987 Schneider ..... 266/45

FOREIGN PATENT DOCUMENTS 0096704 5/1985 Japan ..... 266/45
3007308 1/1988 Japan ..... 266/45
3028809 2/1988 Japan ..... 266/273

*Primary Examiner*—S. Kastler
*Attorney, Agent, or Firm*—Toren, McGeady & Associates

[57] ABSTRACT

In closing furnace tapholes a plugging material is forced into the taphole through the nozzle of a notch gun and simultaneously a tapping rod, which remains in the taphole until the furnace is filled, is introduced into the plugging material. Opening of the taphole by itself is thus avoided.

8 Claims, 4 Drawing Sheets

PROCESS AND NOTCH GUN FOR CLOSING THE TAPHOLES OF FURNACES

TECHNICAL FIELD OF THE INVENTION

The invention relates to a process and a notch gun for closing furnace tapholes wherein plugging material is forced into the taphole through the nozzle of a notch gun and a tapping rod is inserted into the plugging material to remain there until the furnace is tapped.

BACKGROUND OF THE INVENTION AND PRIOR ART

In the operation of furnaces, particularly blast furnaces but also direct reduction shaft or cupola furnaces, crucible furnaces, for example for coal gasification, ladle furnaces or low shaft furnaces for melting ferrous alloys, non-ferrous metals or non-metals, the taphole must be opened from time to time so that the melt or the by-products, e.g. slag, can run off. Depending on the process, the tapping cycle can vary between half an hour and several days. After tapping, the tapholes are closed again with plugging material.

It is known from EP-OS 41 942, when alternatively closing and opening the tapholes of blast furnaces, to drive a rod with a pneumatic hammer through the still not fully hardened plug until its tip reaches the interior of the blast furnace, i.e. the molten charge. While the front end of the rod that is in contact with the molten metal melts away, the rest of the rod remains in the bore hole and is only removed by pulling it out when the furnace is tapped. This so-called "back-pressure drilling process" has been found to be particularly advantageous when the furnace has a thick refractory lining any there are tapholes 2.5 m or more in length.

The success of the back-pressure drilling process depends essentially on precisely determining in advance the right time for driving in the tapping rod. Particular attention must be paid to forcing the plastic plugging material into the taphole under high pressure when tapping is complete, so that the molten material still in the taphole is forced back and the taphole passage is completely filled with the plugging material. This is done by means of a notch gun or taphole plugging machine, which must remain in front of the closed taphole opening for some time after the plugging so as to apply the necessary counterpressure until the plugging material begins to harden. This time depends on the composition of the plugging material, and also to an important extend on the temperature in the taphole and of the refractory lining. The gun is only swung from its operating position to its inoperative position when the material has hardened sufficiently to withstand the pressure in the interior of the furnace, i.e. for it not to be forced out again. In contrast to this requirement, or necessity, is the fact that the tapping rod can only be driven into the taphole while the plugging material in the taphole still has a certain amount of plasticity.

If however the tapping rod is driven into the plastic material too soon, it may happen that an unplanned escape of molten material occurs, with great danger to the operators. To avoid the risk of an unplanned breakthrough of molten material, the operators take care to wait rather longer than necessary before driving in the tapping rod. But too long a delay often results in the driving force of the pneumatic hammer being insufficient to drive the rod into the plugging material, which is then too hard. The back-pressure technique can then no longer be used, and the furnace must be drilled out again using the conventional single- or two-stage drilling process.

Because of the differences in composition of the commercially available plugging materials their hardening time varies a great deal, and in addition it changes with the duration and temperature of storage of the material before use. In many cases the period within which the driving rod ought to, or can, be driven in amounts only to one or two minutes, so that the number of failures is correspondingly large, with the result that the taphole frequently has to be drilled out. In the two-stage drilling process this is done by pre-drilling with a drill bit and then driving a smooth rod through. The relatively expensive drill bit can then be re-used. In single-stage drilling, on the other hand, the refractory lining is drilled through using a cheap bit that can only be used once. Both drilling processes have the disadvantage that the time required for drilling is quite long. In addition annealing of the drill bit may occur, which is particularly disadvantageous in the case of the expensive drill bit used in the two-stage process. Furthermore there is a risk that the drill rod may remain stuck in the taphole and—since it cannot be pulled out again—have to be burned out with an oxygen lance.

OBJECT OF THE INVENTION

The object of the invention is to provide a process and a notch gun by means of which the above-mentioned disadvantages, both in closing and in opening the taphole, can be avoided.

SUMMARY OF THE INVENTION

This object is achieved in a process of the kind mentioned in the introduction in which, according to the invention, the tapping rod is inserted into the taphole together with the plugging material, i.e., as it were, embedded in the plugging material. By thus inserting the tapping rod into the taphole passage at the same time as the plugging material is forced in, i.e. by making it an integral part of the plugging material right from the beginning of the plugging process, the need for the operators to determined the right time to drive in the tapping rod in accordance with the quality and consistency of the plugging material and its binding or hardening time is eliminated. The need to choose the right moment to avoid substantial disadvantages in thus avoided, as is the risk of an unintentional breakthrough of molten material. While the notch gun or the taphole plugging machine is swung away after the plugging material has hardened, the tapping rod remains in the taphole and is not removed until the next tapping.

A suitable notch gun for use in the process is one in which the tapping rod is arranged with its leading end in the plugging material passage of the nozzle. On pressurising the plugging piston of the gun the plugging material is forced into the taphole passage and at the same time the tapping rod is correspondingly moved with it into the taphole passage because of the friction of the plugging material against its surface. Finally the whole of the taphole passage is filled with plugging material and the tapping rod, surrounded by the plugging material, extends through the taphole passage.

It is for example advantageous to provide the leading end of the tapping rod with a radial attachment, which may be formed as a disc, possibly with radial slits therein. This reinforces the surface friction which causes the linear advance of the tapping rod in the plugging direction, since the plugging material that collects behind the disc transfers the force resulting from the stroke of the pressing piston of the plugging gun to the tapping rod.

The tapping rod, which is often several meters long, can advantageously be arranged in a guide, for example in several guiding supports spaced apart on the gun. The guide means for the tapping rod preferably comprises a bore hole in the nozzle of the gun and guiding supports arranged on the outside of the gun. The bore hole is so arranged that it runs in the geometrical prolongation concentric with the mouth of the plugging material passage of the nozzle of the gun, so that the tapping rod inserted in the guides passes centrally through the tapping passage, i.e. at substantially the same radial distance from the walls of the tapping passage.

The tapping rod can be provided with at least one detent groove at the rear end, remote from the disc, in which, in situ, a latch pivotably mounted on the nozzle can engage. By means of the detent that latches into the circumferential groove the penetration of the tapping rod into the furnace interior can be limited, and for example the forward movement of the tapping rod can be stopped after its front end has dipped into the melt. At the same time, the length of the tapping rod projecting from the outer wall of the furnace after the gun has been swung away can be maintained constant. For tapping, a back-pressure machine can for example be connected to the outwardly projecting end of the tapping rod and the tapping rod removed from the taphole passage: the detent groove can provide a positive connection between the tapping rod and the coupling which assists the coupling.

A closure bolt having a detent groove is preferably arranged it he axial bore hole. While the notch gun is not in use, and while it is being filled with plugging material, the closure bolts that are inserted in the bore hole and are prevented from being lost by the latch arranged at the nozzle facilitate the later introduction of the tapping rod and avoid damage to the axial bore hole from occurring in rough blast furnace operation. The closure bolt can also prevent the plugging material from escaping as the notch gun is filled.

BRIEF DESCRIPTION OF THE DRAWINGS

The invention will now be explained in more detail by way of example with reference to the embodiment shown in the drawing, in which.

DETAILED DESCRIPTION OF PREFERRED EMBODIMENTS OF THE INVENTION

Figure 1:
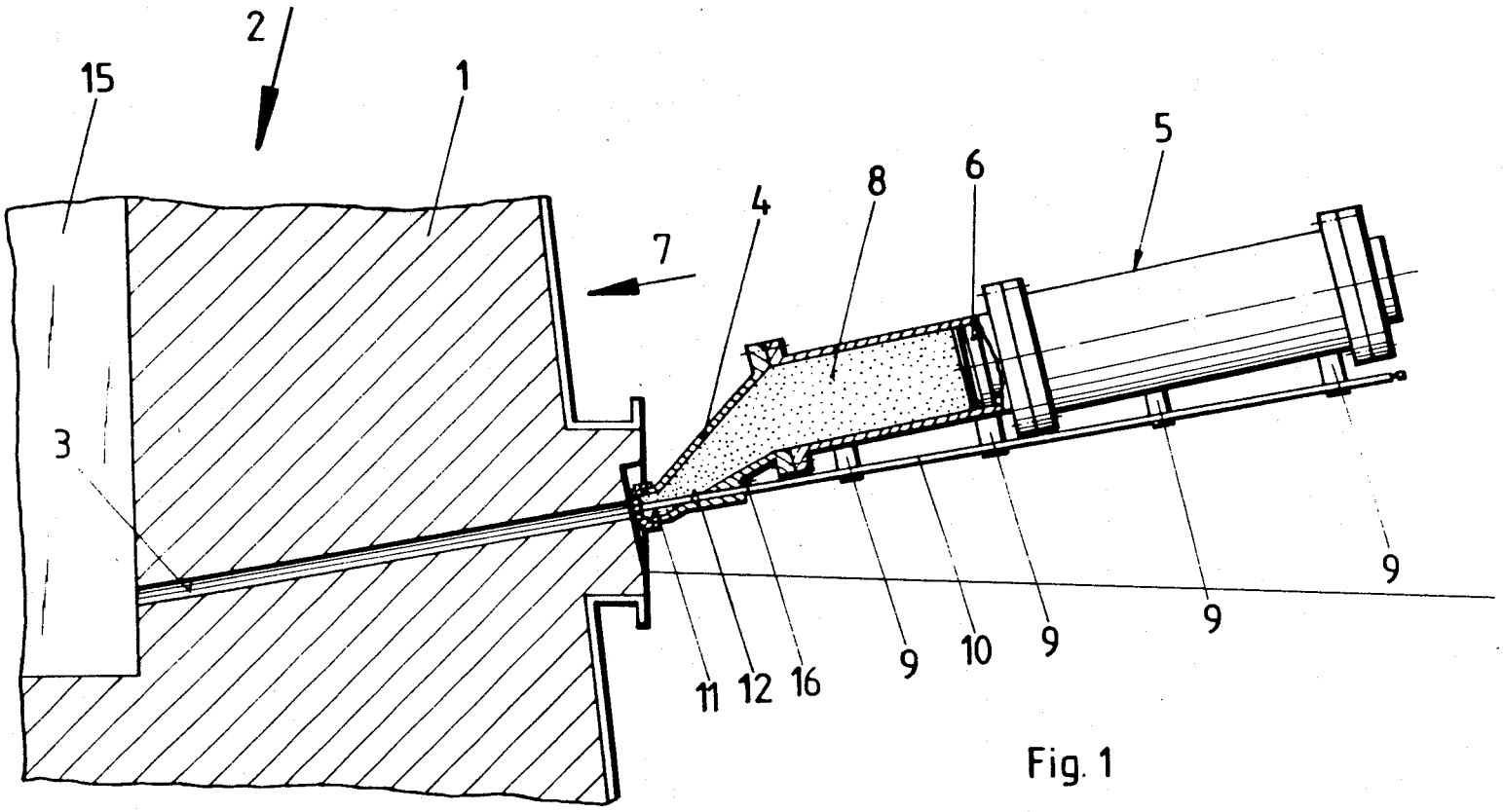
FIG. 1 shows a notch gun according to the invention in the starting position before plugging, pressed against the lining of a melting furnace, shown only in part.

In order to close a taphole passage 3 previously drilled by a taphole drilling machine (not shown) through the refractory lining 1 of a melting furnace 2, the nozzle 4 of a notch gun 5 is pressed against the lining 1, and plugging material 8 is forced into the passage 3 on pressurising a pressure piston 6 of the gun 5 in the forward stroke direction 7. In the operating position shown in FIGS. 1 and 2 before the plugging, the nozzle 4 surrounds the mouth of the taphole passage 3 on the outer wall of the furnace 2.

Figures 2, 6:
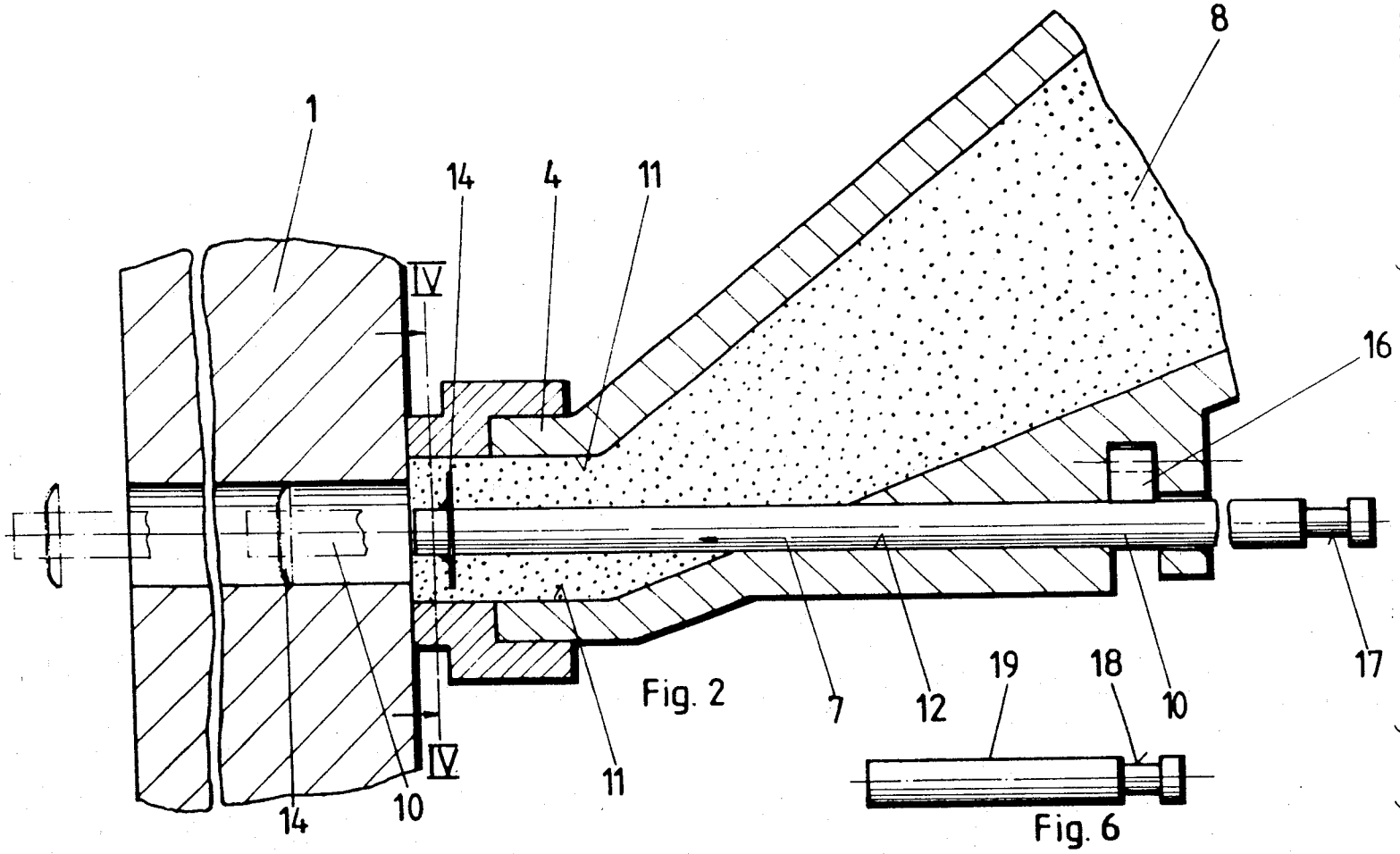
FIG. 2 shows as a detail and in longitudinal section the nozzle of the gun of FIG. 1 with a tapping rod inserted in it.
FIG. 6 shows a longitudinal view of a closure bolt.
Figure 4:
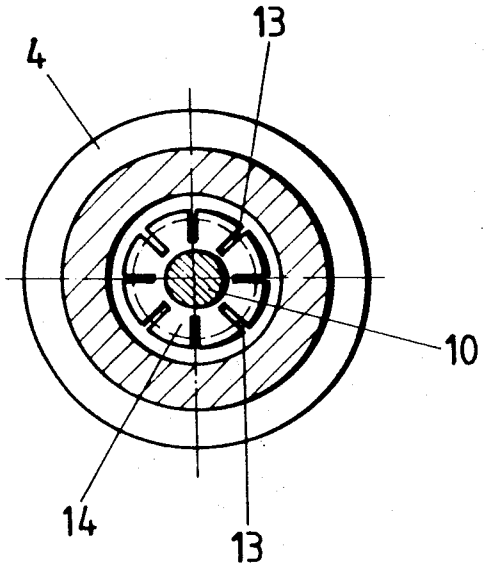
FIG. 4 shows the nozzle of the plugging machine section along the line IV—IV in FIG. 2.

In the starting position, i.e. before plugging, the leading end of a tapping rod 10, inserted in a plurality of spaced guides 9 on the outside of the gun 5, projects into the plugging material passage 11 of the nozzle 4 and ends immediately in front of the taphole passage 3 or the passage opening in the lining 1 (cf. FIG. 2). To guide the tapping rod 10 the nozzle is provided with a bore hole 12 which—like the guides 9—runs so that the tapping rod 10, which has a smaller diameter than the taphole passage 3, is located centrally of the passage 3. The leading end of the tapping rod 10 is provided with a deformable disc 14 having radial slits 13 (see FIG. 4) and having a diameter larger than that of the tapping passage 3.

Figure 3:
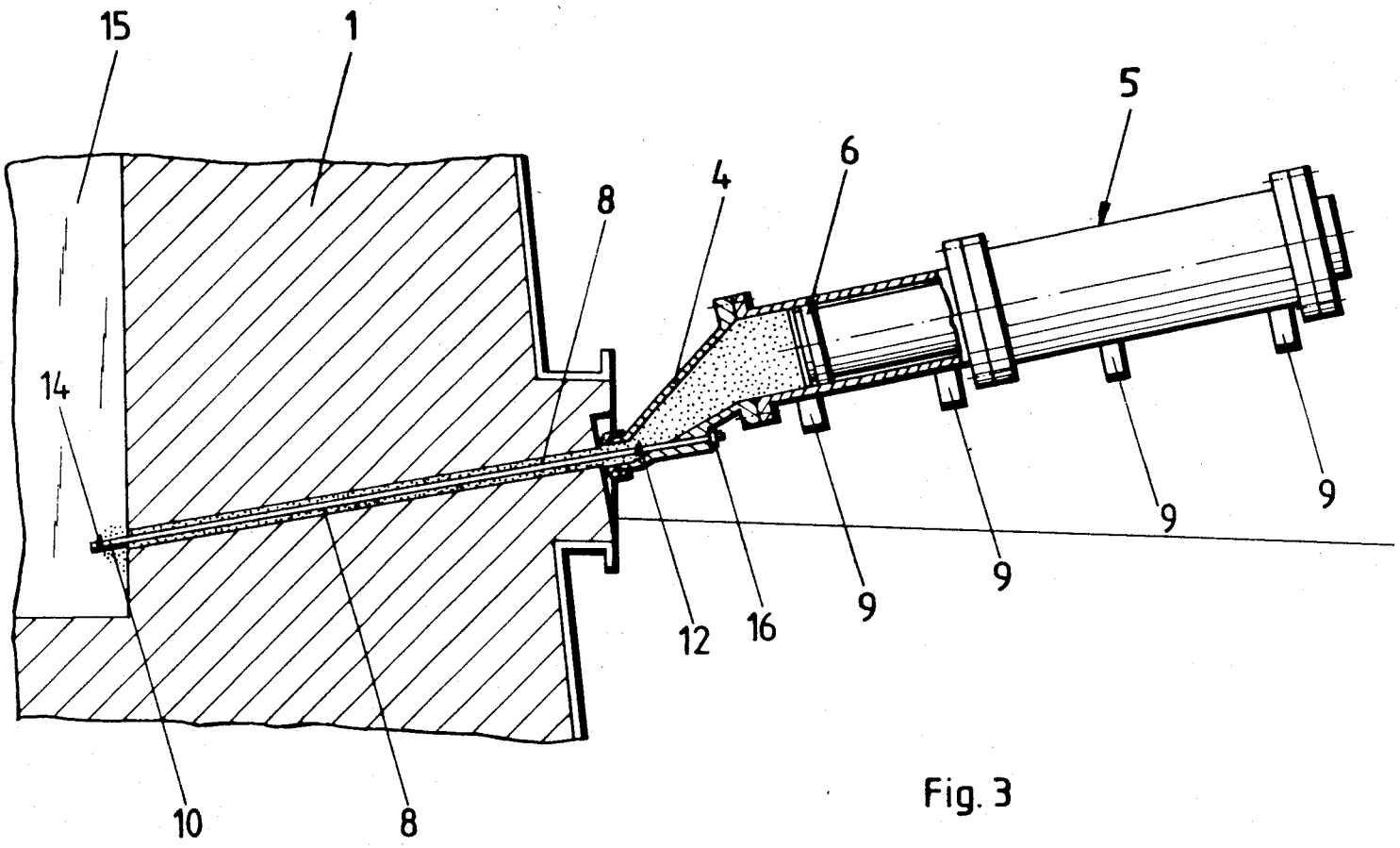
FIG. 3 shows a view corresponding to FIG. 1, but at the end of the plugging process, in which the leading end of the tapping rod is in the furnace interior.

In operating the notch gun 5 the piston 6 forces the plugging material 8 in the direction of its forward stroke 7, and at the same time the plugging material 8 carries the tapping rod 10 with it until its leading end projects into the interior of the melting furnace 2 (FIG. 3). In the course of filling the tapping passage 3 with plugging material 8 and of the simultaneous forward movement of the tapping rod 10 the rim of the disc 14 is, after entering the passage 3, bent counter to the forward stroke direction 7 (cf. the intermediate position shown in broken lines in FIG. 2) and in this way lies closely against the wall of the taphole passage 3, thus assisting the carrying forward of the tapping rod 10 by the plugging material 8 collecting behind the disc 14 in the direction of the forward stroke 7. The radial slits 13 facilitate the bending of the disc 14 if this is not sufficiently elastic.

Figure 5:
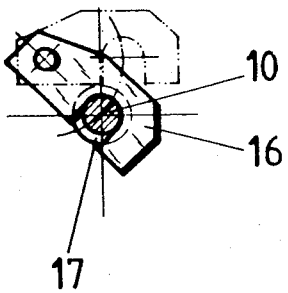
FIG. 5 shows as a detail a latch pivotably mounted in the nozzle of the gun.

After the tapping rod 10 has reached the position shown in FIG. 3, with its leading end projecting into the interior 15 of the melting furnace 2, a pivotable latch 16 (FIG. 5) engages in a detent groove 17 at the rear end of the tapping rod 10 and prevents it from being carried further, i.e. prevents further forward movement of the rod 10 in the direction 7. After the plugging material 8 has hardened in the taphole passage 3 it is only necessary to lift the latch 16 and to swing the notch gun 1 away. The tapping rod 10 remains in the tapping passage 3, which is also closed by the plugging material 8, until the next tapping.

In order to protect the hole 12 in the inoperative position of the gun 1, and to enclose the plugging material (8) during filling, a closure bolt 19, shown in FIG. 6, provided with a detent groove 18, can be inserted into the hole 12 and held securely in position by the latch 16.

What is claimed is:

1. A notch gun for sealing a furnace taphole having a channel with a plugging material, comprising:

a nozzle having a plugging material channel;

a tapping rod introducible together with the plugging material into the taphole channel by way of the nozzle, the tapping rod having a front end, a rear end and an initial position in which the front end is arranged in the plugging material channel of the nozzle and the rear end is located outside the nozzle; and guide means for the tapping rod, said guide means including a guide bore arranged in the nozzle so as to be concentric to the plugging material channel.

2. A notch gun according to claim 1, and further comprising a gun body connected to the nozzle, said guide means including guides for the tapping rod provided on the gun body.

3. A notch gun according to claim 1, and further comprising a closure bolt removably located in said axial hole and having a detent groove.

4. A notch gun according to claim 1, and further comprising a latch pivotably mounted on the nozzle and arranged so as to engage in a detent groove in the tapping rod or in a closure bolt.

5. A notch gun according to claim 1, wherein said tapping rod has at least one radial attachment formed as a disc at the front end of the tapping rod.

6. A notch/gun according to claim 5, wherein the disc is elastic and has a larger diameter than the taphole.

7. A notch gun according to 5, wherein the disc has radial slits.

8. A notch gun according to claim 1, wherein the tapping rod has a detent groove on its rear end.

* * * * *